US005632407A

United States Patent [19]

Christensen

[11] Patent Number: 5,632,407

[45] Date of Patent: May 27, 1997

[54] ADAPTER FOR A DRINK CONTAINER

[76] Inventor: Arthur E. Christensen, 1316 Dulaney Valley Rd., Towson, Md. 21286

[21] Appl. No.: 584,741

[22] Filed: Jan. 11, 1996

[51] Int. Cl.[6] ..... A47J 19/00

[52] U.S. Cl. ..... 220/717; 220/703; 220/718

[58] Field of Search ..... 220/716, 717, 220/718, 703, 704

[56] References Cited

U.S. PATENT DOCUMENTS

| | | | |
|---|---|---|---|
| 2,284,625 | 6/1942 | Smith et al. | 220/717 |
| 2,582,934 | 1/1952 | Parsons | 215/100 |
| 2,729,956 | 1/1956 | Gilbert | 65/13 |
| 2,778,521 | 1/1957 | Cagle | 215/74 |
| 3,021,977 | 2/1962 | Hester | 220/718 |
| 3,185,341 | 5/1965 | Barbour | 220/718 |
| 4,146,157 | 3/1979 | Dixon, Sr. et al. | 220/717 X |
| 4,801,027 | 1/1989 | Hunter | 220/717 X |
| 4,872,569 | 10/1989 | Bolte | 215/12.1 |
| 5,433,353 | 7/1995 | Flinn | 220/703 X |

*Primary Examiner*—Steven M. Pollard
*Attorney, Agent, or Firm*—Leonard Bloom

[57] ABSTRACT

An adapter is attached to a cover of a squeezable drink container for preventing a direct contact between a user's mouth and the container outlet. The adapter comprises a cup, an upper edge of which rests around the user's mouth during drinking. The cup has circumferentially spaced-apart side openings for draining an excess of the liquid supplied to the user's mouth.

11 Claims, 9 Drawing Sheets

ADAPTER FOR A DRINK CONTAINER

STATEMENT REGARDING FEDERALLY SPONSORED RESEARCH OR DEVELOPMENT (Not applicable)

CROSS REFERENCE TO RELATED APPLICATIONS (Not applicable)

REFERENCE TO A MICROFICHE APPENDIX SPECIFYING THE TOTAL NUMBER OF MICROFICHE AND TOTAL NUMBER OF FRAMES (Not applicable)

BACKGROUND OF THE INVENTION

The present invention relates to improvements to squeezable drink containers, and more particularly, to an adapter attached to the top of the drink container for spacing a user's mouth from the drink container outlet for overcoming possible health problems which may be caused by the unsanitary practice of sharing the drink container by several users, for instance, sports team, or the like.

Squeezable drink containers such as, for instance, Gatorade®, are frequently used by several people such as a sports team. Each person drinks from the same drink container by placing his or her mouth to the outlet of the drink container and squeezing the latter. It is understood that this is an unsanitary practice to share the same drink container by several people if a direct contact between the drink container outlet and the user's mouth takes place during drinking, and this practice may cause health problems.

It is known in the art to attach a drinking cup to the top of a beverage container.

For instance, U.S. Pat. No. 2,778,521 describes a closure cap attached to the neck of the liquid cooling container and having a valve facilitating filling the container and dispensing the liquid therefrom.

In U.S. Pat. No. 2,729,956, a cup-like element is removably and telescopically attached to a cylindrical can with a beverage to facilitate drinking directly from the can.

Bottle top drinking cups are also described in U.S. Pat. Nos. 2,582,934, 3,021,977 and 4,872,569. The drinking cup is readily detached from the respective bottle after performance of its functions, and if desired, is replaced by another drinking cup.

All these drinking cups serve, in some degree, for better sanitary purposes, since after replacing the used drinking cup by a clean one, the next user is not subjected to the influence bacteria, infectious viruses and germs of a previous user. However, the main intention of the above cups is to serve as an outlet of the drinking vessel (bottle or can) which is shaped conveniently for the user to drink the beverage directly from the bottle or the can without dispensing the beverage into a separate glass or a cup.

Disadvantageously, to be protected from transmission of various bacteria, viruses and germs, the users sharing the same beverage container should have handy a plurality of disposable aforesaid drinking cups, that is, at least, not conveniently available for immediate use.

Besides, if shared by sport teammates during the rest time, or during time when the player is substituted by another one and has to be refreshed, it is clear that hardly anyone of these people will spend any time or effort for replacing disposable drinking cups. They simply pass the beverage container from one person to another for consumption, and the problem remains unsolved.

Therefore, it would be highly desirable to have more convenient means to overcome possible negative sequences of the same beverage container shared by several people.

BRIEF SUMMARY OF THE INVENTION

It is, therefore, an object of the present invention to provide an inexpensive, simple and convenient to use means for avoiding transmission of viruses, bacteria and germs between users of the same drink container.

The present invention is not a drinking cup and is not to be disposed and replaced by another piece in order to provide a sanitary protection for the users of the drink container.

According to the teaching of the present invention, the present invention is an adapter attached to an outlet of a drink container and spacing the user's mouth therefrom, thereby preventing a direct contact of the user's mouth with the container outlet, and thereby preventing possible health problems associated with an unsanitary practice of sharing the drink container by several users.

The adapter comprises a cup surrounding the container outlet. The cup has an upper edge resting around the user's mouth during drinking. Preferably, the cup has circumferentially spaced-apart side openings such that an excess of the liquid supplied to the user's mouth drains trough said openings.

Preferably, the cup is of conical shape. The drink container includes a cover removably secured to the top thereof, such that the container outlet shaped as a tube (tube-like body) integral with the cover and centrally extending therefrom.

Preferably, the adapter is integrally molded with the cover. But it also can be glued to the cover.

Viewing in another aspect, the present invention is an improved cover removably secured to a top of the squeezable drink container. The improved cover comprises a tube container outlet centrally extending from the cover to supply a drink from the drink container to a user's mouth, and an adapter attached to the cover to prevent the direct contact between the user's mouth and the tube container outlet during drinking. The adapter is preferably of a conical shape, but may also be of venturi shape. Being of venturi shape, the adapter comprises a lower sleeve and an upper cup integral with the lower sleeve. The lower sleeve is secured by its lower edge to the cover and surrounds the tube container outlet. The upper edge of the upper cup surrounds the user's mouth during drinking.

Arranged in the aforesaid manner, the adapter maintains a distance between the tube container outlet and the user's mouth, thereby overcoming possible health problems associated with sharing the drink container by a plurality of the users.

Preferably, the improved cover includes internal threads, while the drink containers includes external threads at its top, such that the cover is removably secured to the drink container by means of engagement between the internal threads of the cover and the external threads of the drink container.

These and other objects of the present invention will become apparent from a reading of the following specification taken in conjunction with the enclosed drawings.

DESCRIPTION

Referring to FIGS. 1–9, a drink container 10 has a top 11 and a cover 12 which is removably attached to the top 11.

Figure 1:
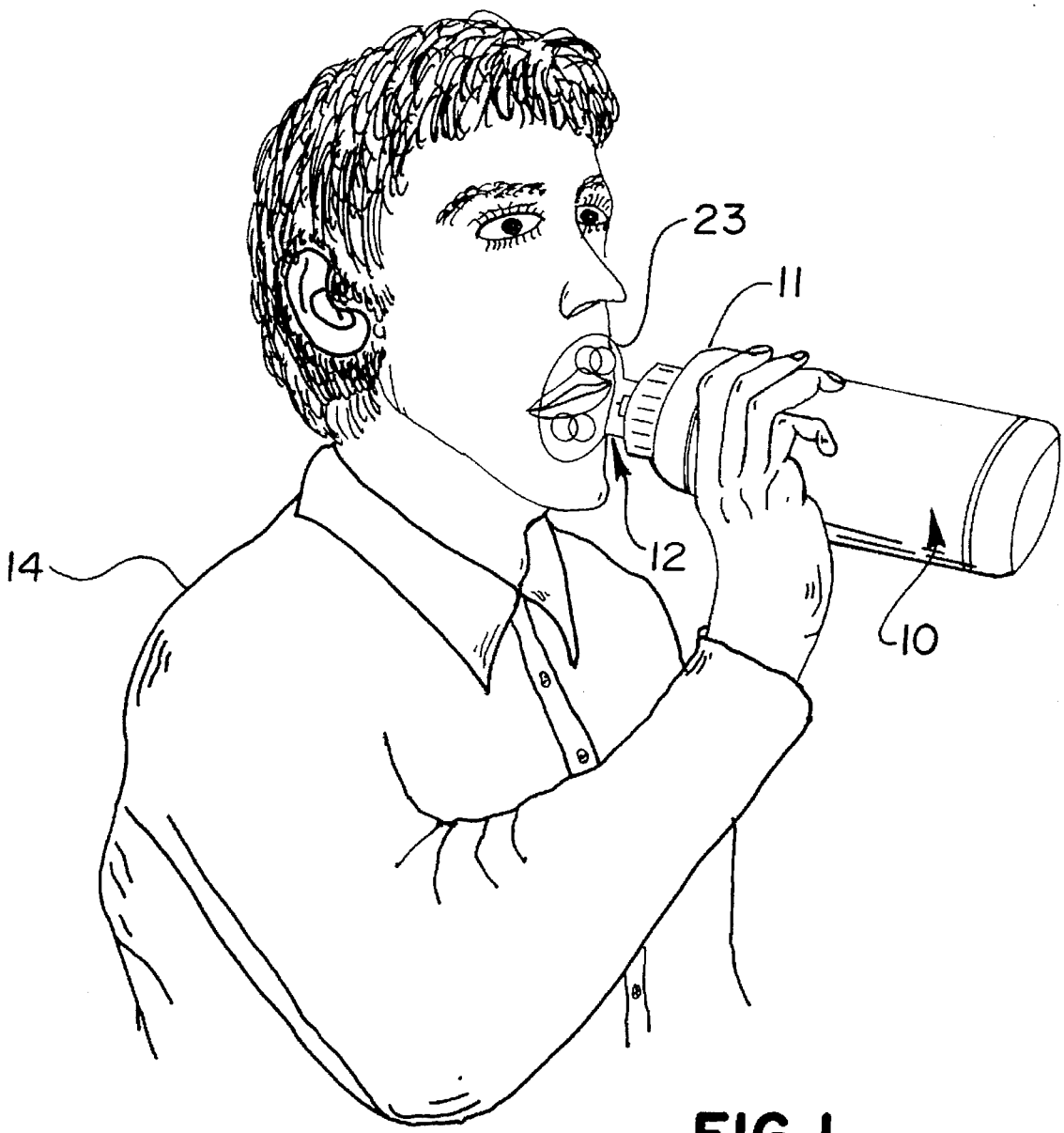
FIG. 1 shows a drink container with the cover of the present invention during drinking by a user.
Figure 2:
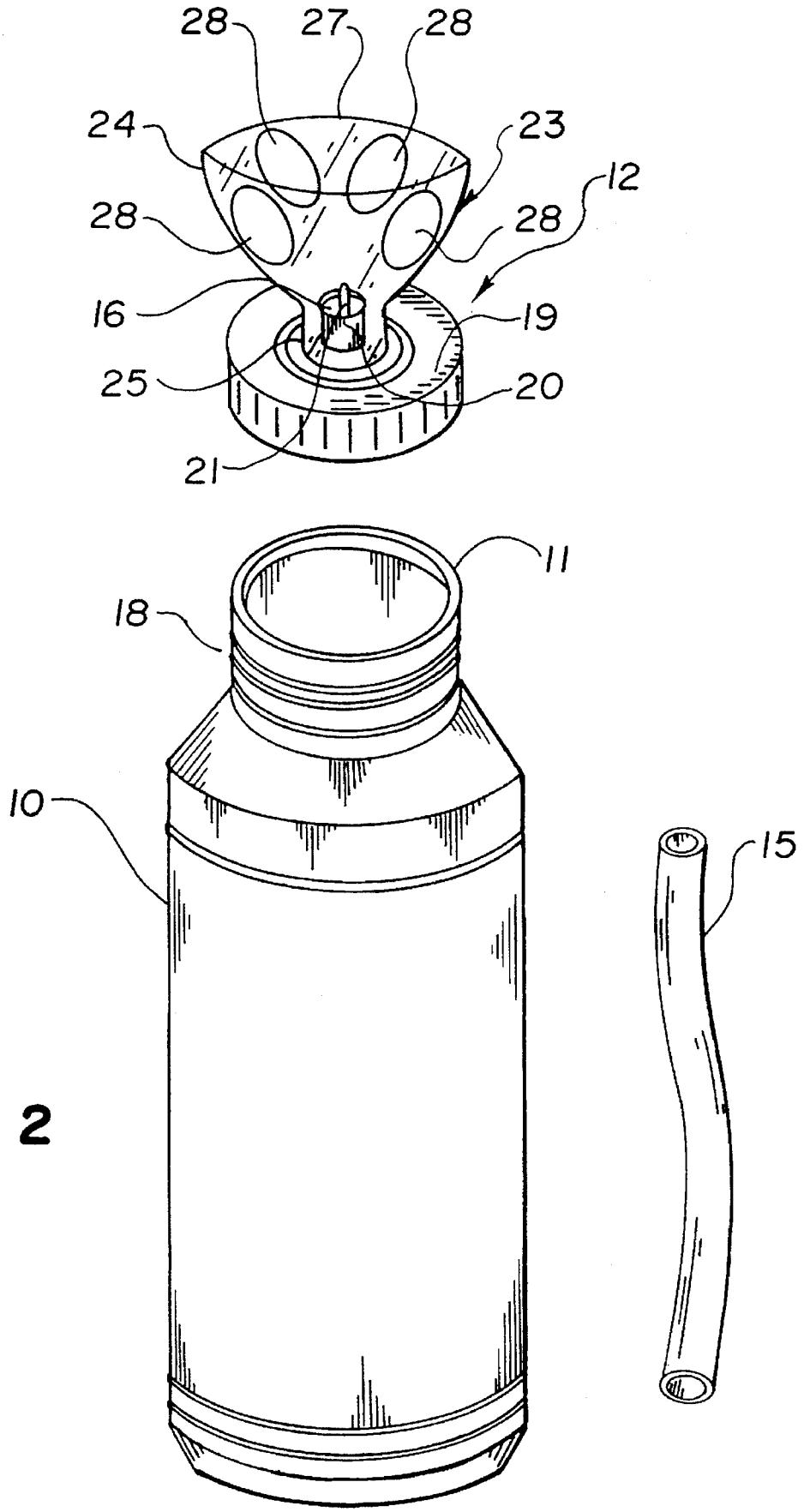
FIG. 2 is an exploded perspective view of a Gatorade®squeezable drink container with an improved cover having an adapter of the present invention.
Figure 3:
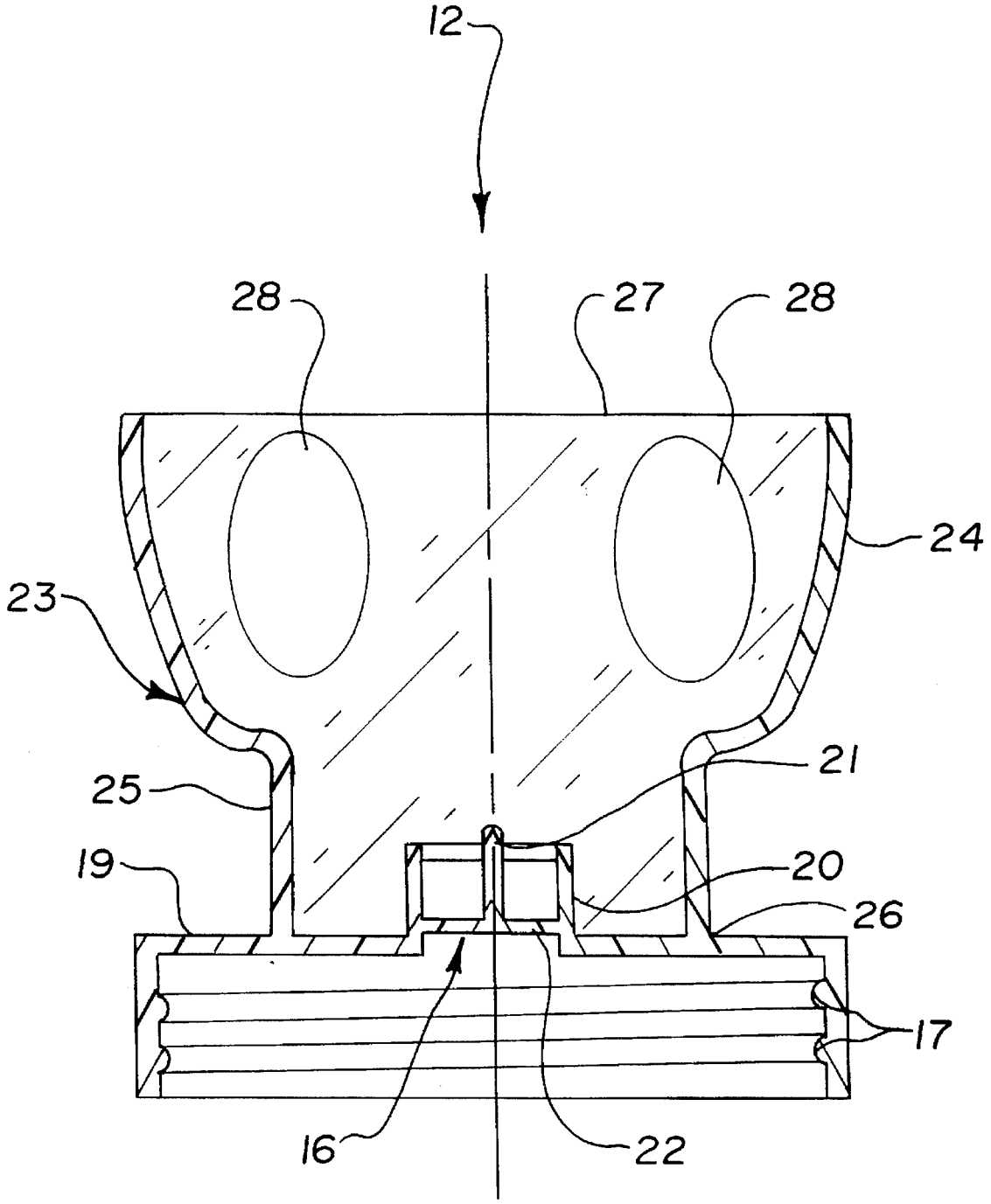
FIG. 3 is a longitudinal cross-section of the cover of the present invention.
Figure 4:
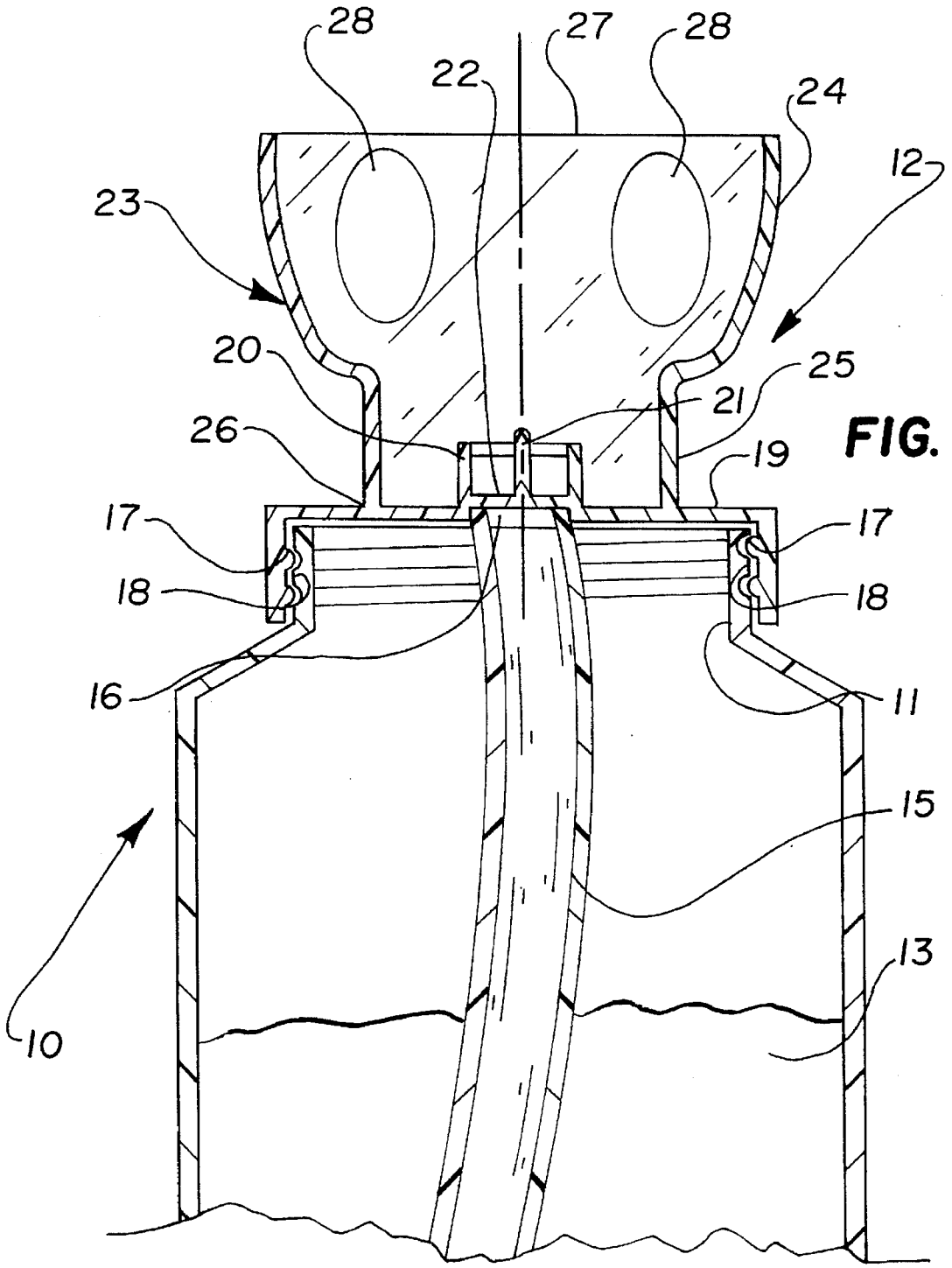
FIG. 4 is a longitudinal cross-section view of the drink container with the attached cover of the FIG. 2.
Figure 5:
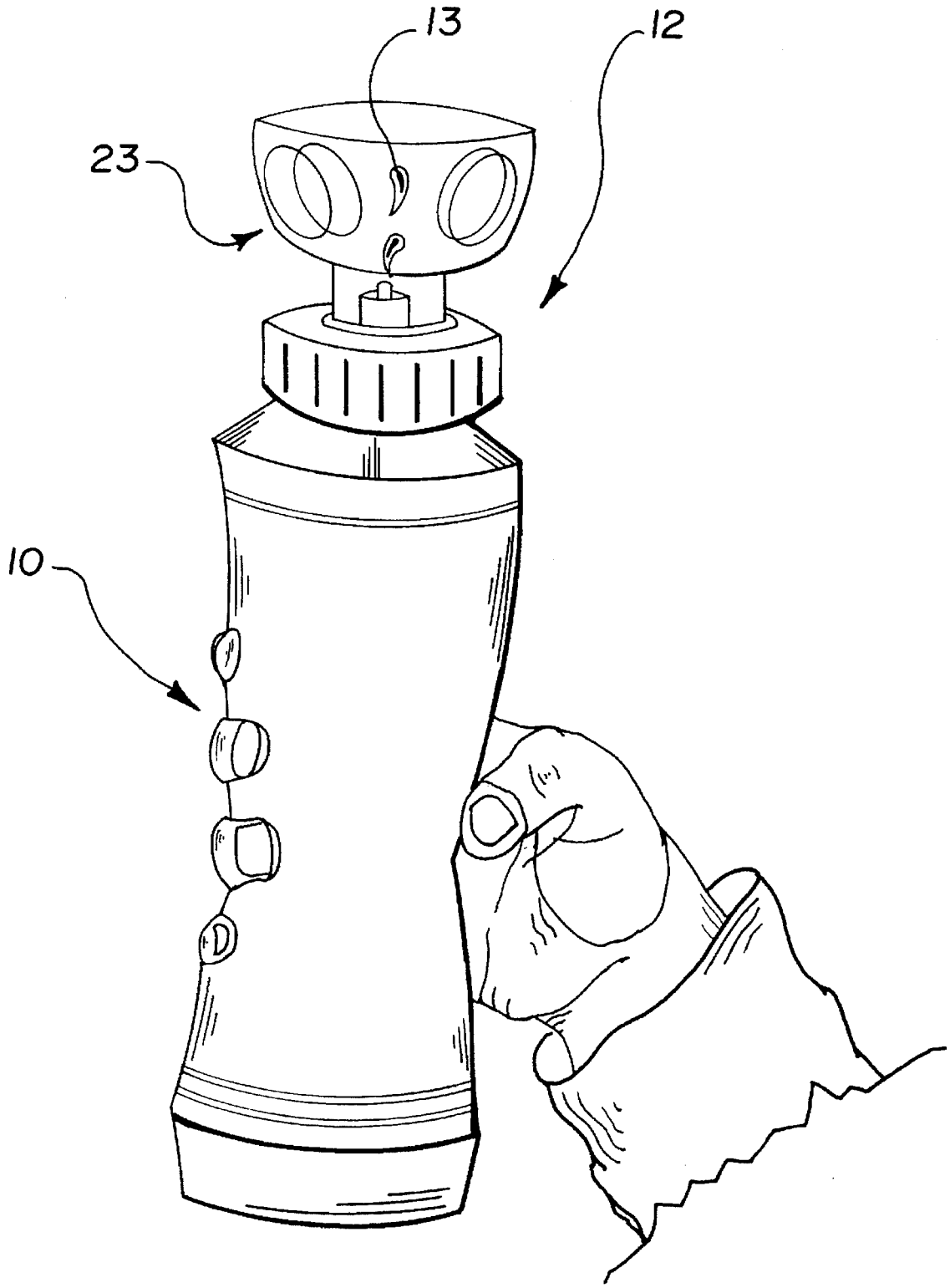
FIG. 5 is a drink container with the cover of FIG. 4 showing the liquid supplied to the container outlet while the drink container is squeezed.
Figure 6:
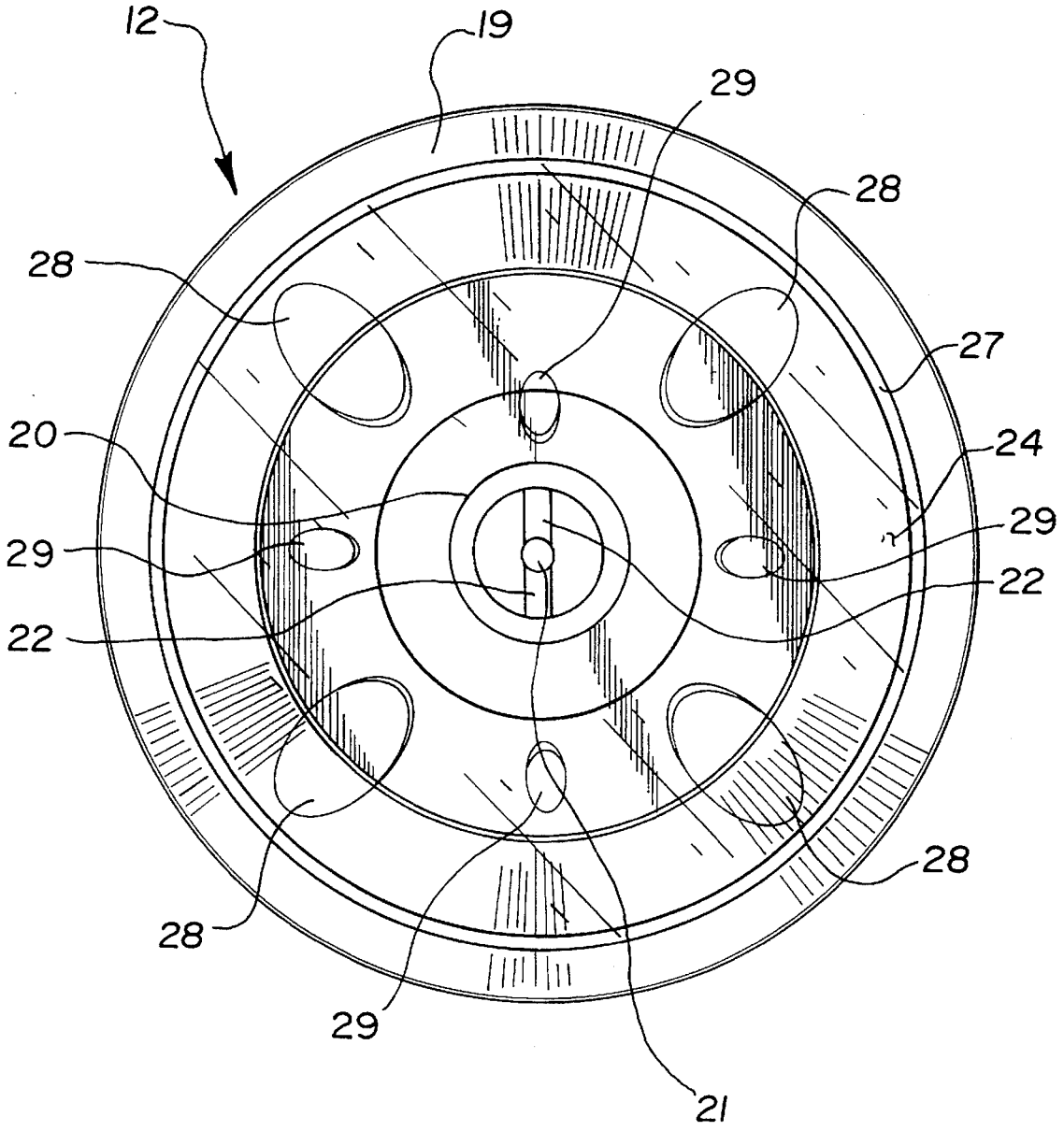
FIG. 6 is a top view of the cover with the adapter of the present invention.
Figure 7:
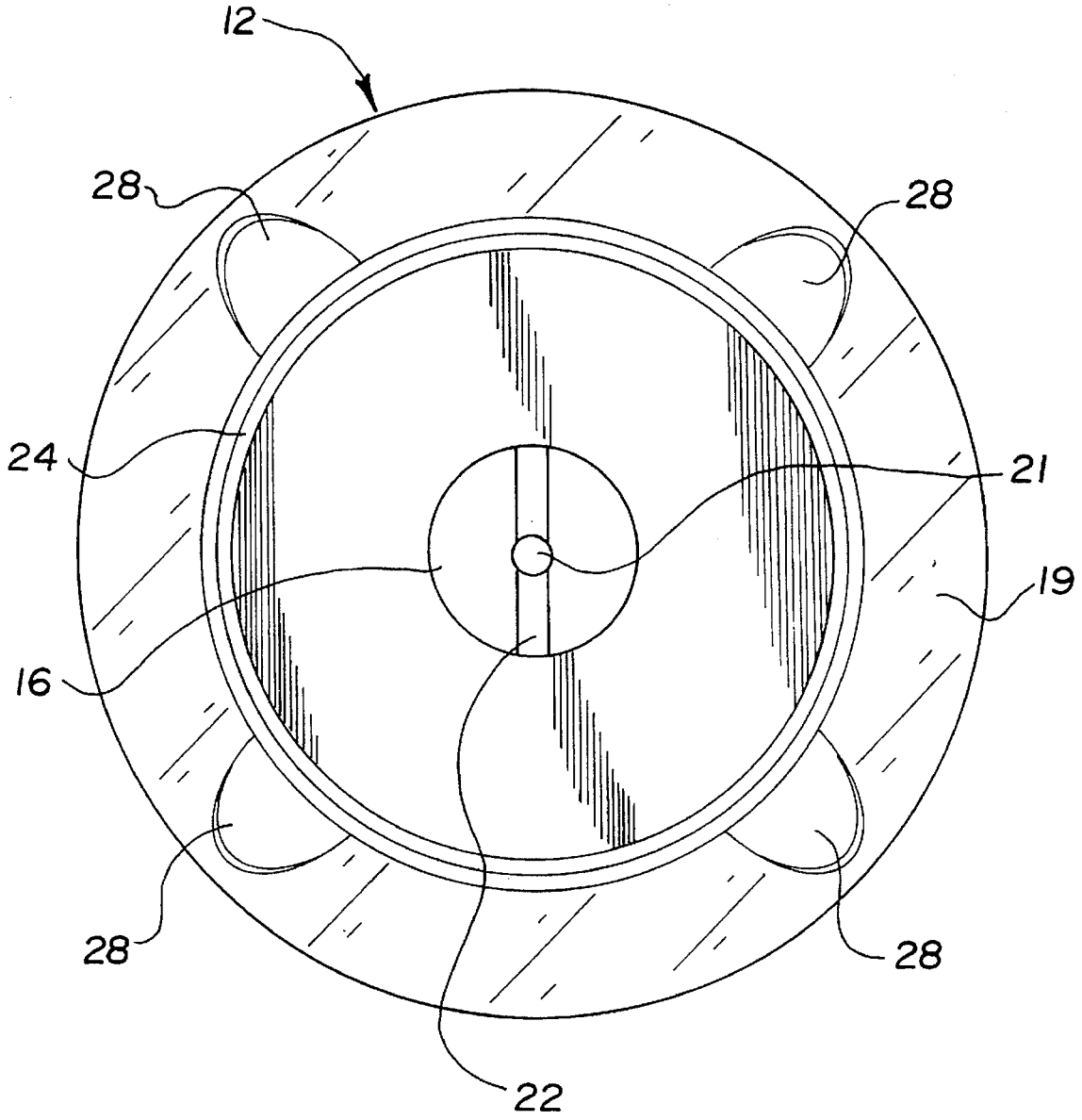
FIG. 7 is a bottom view of the cover with the adapter of the present invention.

The container 10 is a squeezable plastic drink container, for example, Gatorade THIRST Quencher®. As best shown in FIG. 1, when a liquid 13 (a beverage or a pure water) contained in the container 10 is to be consumed, the container is squeezed by a user 14 and the liquid 13 is led from the container 10 with (or without) a straw 15 to an outlet 16 of the container 10, and further, via the outlet 16 to the user's 14 mouth as a liquid 13 jet.

The container 10 is conventional and includes a cover 12 having internal threads 17 which are brought into engagement with external threads 18 provided on the top 11 of the container 10 for removably securing the cover 12 to the container 10. The cover 12 has a top 19 wherefrom the outlet 16 is centrally extended towards the user's 14 mouth. The outlet 16 has a tube-like body (a tube) 20 integrally molded with the cover 12. A baffle 21 is supported within the tube-like body 20 by struts 22. The baffle 21 serves for leading the liquid jet directly towards the user's 14 mouth.

Figure 8:
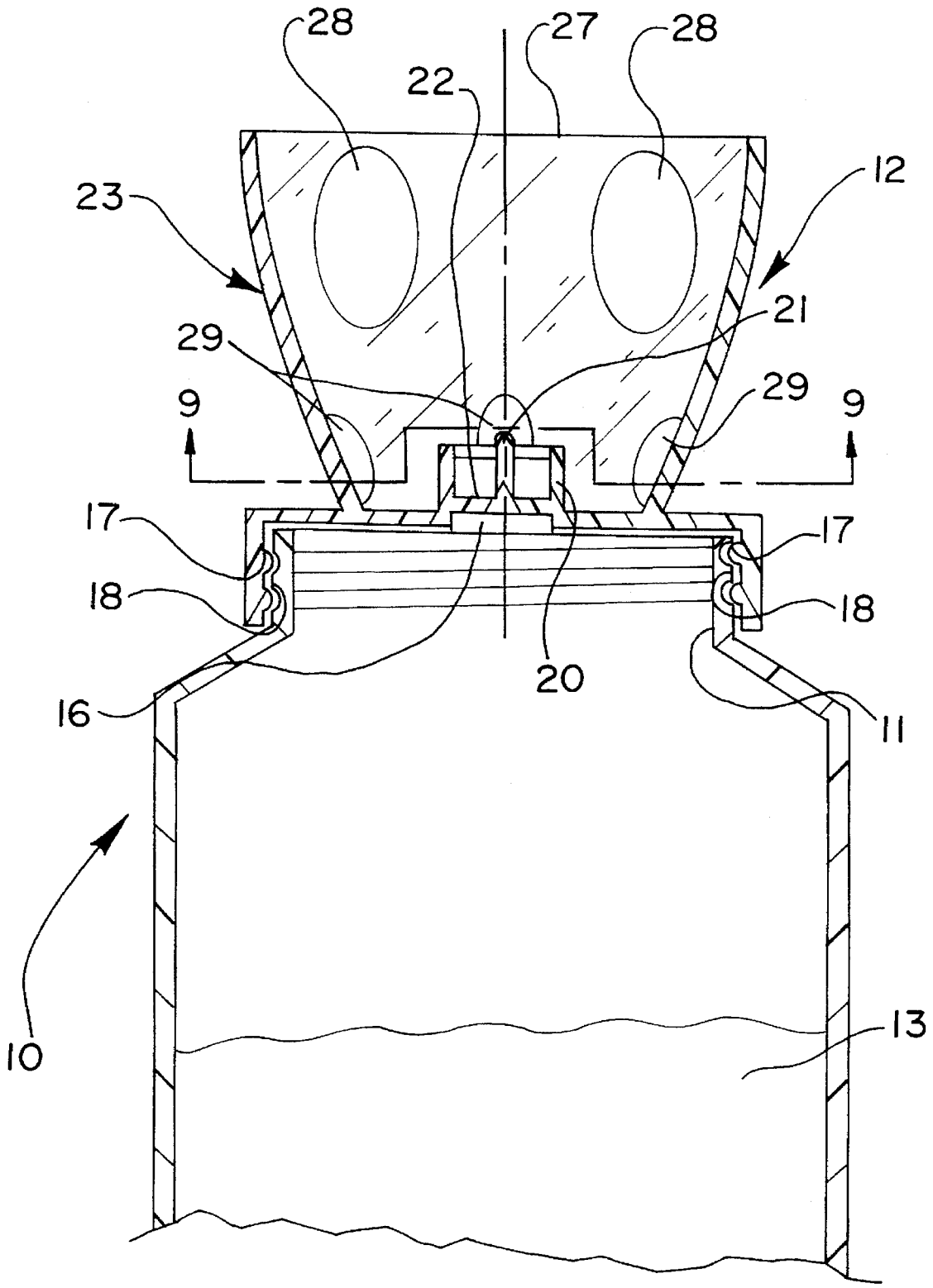
FIG. 8 is a longitudinal cross-section view of the drink container with a conical adapter.
Figure 9:
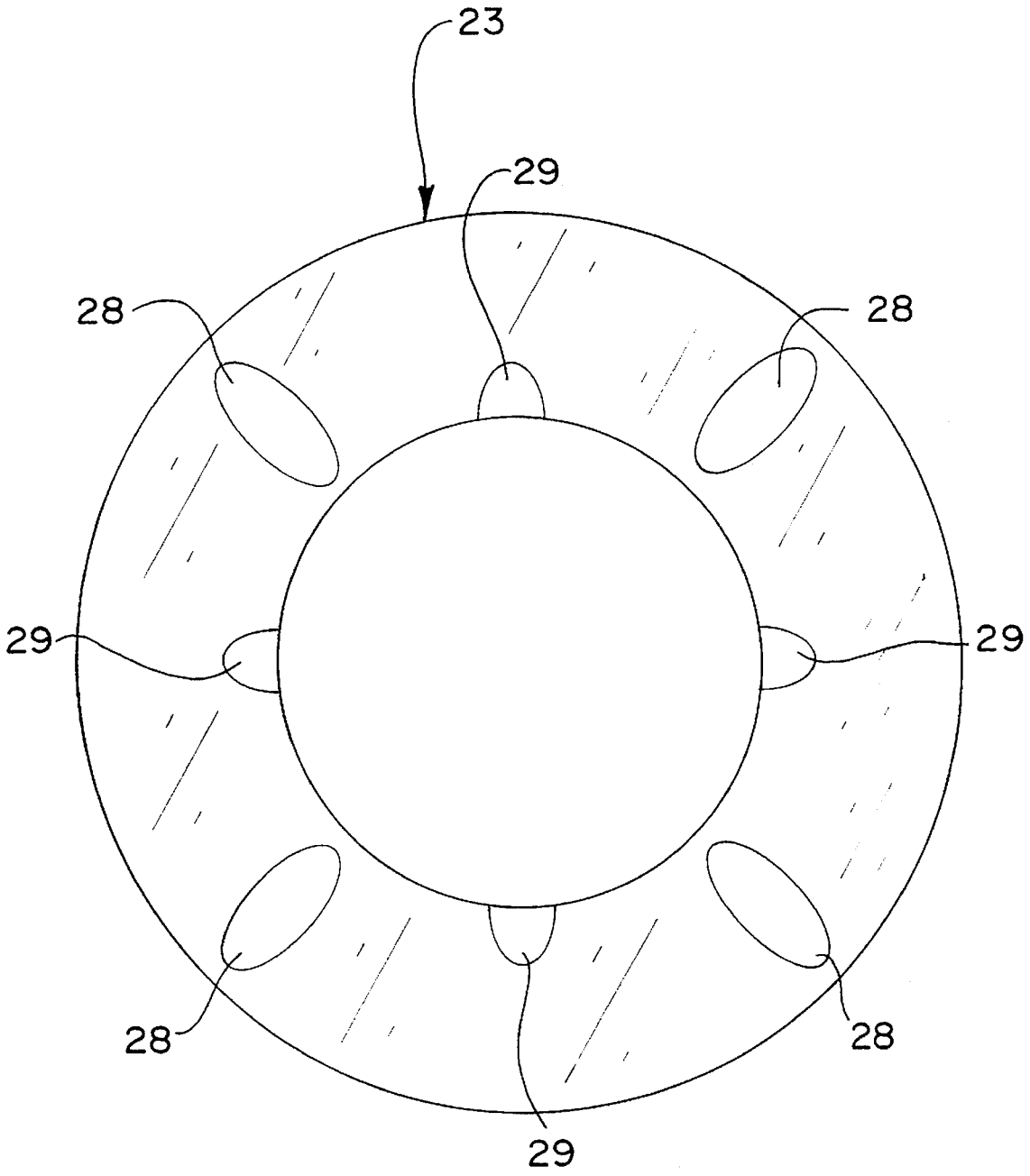
FIG. 9 is a top view of the cover with the adapter shown in FIG. 8.

In accordance with the teachings of the present invention, an adapter 23 is attached to the bottom 19 of the cover 12. The adapter 23 can be integrally molded with the cover 12 or it can be glued (thermally or mechanically) to the top 19. The adapter 23 is made of any plastic used in the food industry, and can be opaque or transparent. The adapter 23 can be made of venturi shape (as shown in FIGS. 1–7), but preferably has conical shape (as shown in FIGS. 8 and 9). The adapter 23, shown in FIGS. 1–7, includes a lower sleeve 25 and an upper cup (or a cup) 24 (preferably, of a conical shape) integral with the lower sleeve 25. The lower sleeve 25 is attached by its lower edge 26 to the cover 12 and surrounds the tube-like body of the container outlet 16. The tube-like body 20 is shorter in length than the length of the lower sleeve 25.

When the container 10 is used, an upper edge 27 of the adapter 23 rests on the user's 14 cheek and/or chin and surrounds the user's 14 mouth.

For the conical adapter, shown in FIGS. 8 and 9, the cup 24 has a lower edge directly attached to the cover 12.

As it will be appreciated, the adapter 23 spaces the user's 14 mouth from the outlet 16, thereby preventing direct contact of the user's 14 mouth (lips) with the outlet 16 during consumption of the liquid contained within the container 10. If the container 10 is used by several users, the adapter 23 maintains a distance between lips of each of the users and the outlet 16, thereby preventing any possible health problems associated with transmission of germs, bacteria and viruses from the lips of one user to the lips of another one.

The adapter 23 has circumferentially spaced-apart side openings 28 and 29 serving for draining an excess of the liquid 13 supplied to the user's 14 mouth through the openings 28 and 29.

Obviously, many modifications may be made without departing from the basic spirit of the present invention. Accordingly, it will be appreciated by those skilled in the art that, within the scope of the appended claims, the invention may be practiced other than has been specifically described herein.

I claim:

1. In combination with a squeezable drink container having a container outlet through which a liquid container in the drink container is dispensed to a user's mouth comprising an adapter attached through attaching means to the container outlet and surrounding said outlet, with the adapter spacing the user's mouth from the container outlet such that the user's mouth can not come into contact with the container outlet, thereby preventing direct contact of the user's mouth with the container outlet, and thereby preventing possible health problems associated with an unsanitary practice of sharing the drink container by several users, said adapter having an upper peripheral edge, spaced from said attaching means which in use is disposed between the user's nose and chin and surrounding the user's mouth, and with the adapter further having circumferentially spaced-apart side openings, such that an excess of the liquid supplied to the user's mouth drains externally of the adapter through said openings.

2. The combination of claim 1, wherein the adapter comprises cup having a substantially conical shape.

3. The combination of claim 2, further including a cover removably secured to the drink container, wherein the container outlet is a tube integral with the cover and centrally extending therefrom a length considerably shorter than the length of the cup, so that the user's lips cannot come in contact with the cup.

4. In combination with a squeezable drink container and a cover removably secured to a top of the drink container, wherein the cover includes a tube container outlet centrally extending from the cover to supply a liquid from the drink container to a user's mouth and, wherein a plurality of users may drink from the same drink container, an improvement in the cover, comprising an adapter attached to the cover to prevent a direct contact of the user's mouth with the container outlet during drinking, the adapter comprising a cup having a sidewall having a lower edge and an upper edge, wherein the lower edge of the cup sidewall is secured to the cover and surrounds the container outlet, wherein the upper edge of the cup sidewall surrounds the user's mouth, wherein the adapter maintains a distance between the container outlet and the user's mouth during drinking, thereby overcoming possible health problems associated with the unsanitary practice of sharing the drink container by a plurality of users, and wherein the cup is provided with a plurality of spaced-apart sidewall openings for draining excess liquid.

5. The improvement of claim 4, wherein the adapter is integrally molded with the cover.

6. The improvement of claim 4, wherein the adapter is glued to the cover.

7. In combination with a squeezable drink container, a cover removably secured to a top of the drink container, the cover comprising:

a tube container outlet centrally extended from the cover to supply a drink from the drink container to a user's mouth, an adapter attached to the cover and surrounding said outlet to prevent direct contact between the user's mouth and the tube container outlet during drinking, wherein the adapter comprises a cup having a sidewall having a lower edge and an upper edge, wherein the cup sidewall is secured by its lower edge to the cover and surrounds the tube container outlet, wherein the upper edge of the cup sidewall surrounds the user's mouth, wherein the adapter maintains a distance between the tube container outlet and the user's mouth, thereby overcoming possible health problems associated with sharing the drink container by a plurality of the users, and wherein the cup sidewall has a lower portion provided with a plurality of openings for drainage of excess externally of said adapter during drinking, so that excess fluids cannot drain back into the container.

8. The cover of claim 7, further including a baffle supported centrally by struts within the tube container outlet.

9. The cover of claim 7, further including integral threads, wherein the drink container includes external threads at its said top, and wherein the cover is removably secured to the drink container by engaging the internal threads of the cover and the external threads of the drink container.

10. The cover of claim 7, wherein the cup of the adapter includes a drain portion having a plurality of side openings for draining therethrough an excess of the drink.

11. An adapter for a squeezable drink container having a container outlet through which a liquid contained in the drink container is dispensed to a user's mouth said adapter spacing the user's mouth from the container outlet such that the user's mouth can not come into contact with the container outlet, thereby preventing direct contact of the user's mouth with the container outlet, and thereby preventing possible health problems associated with an unsanitary practice of sharing the drink container by several users, said adapter comprising an upper peripheral edge which in use is disposed between the user's nose and chin and surrounding the user's mouth, the adapter having circumferentially spaced-apart side openings, such that an excess of the liquid supplied to the user's mouth can drain externally of the adapter through said openings and the adapter having means for attaching said adapter to said container outlet, such that said adapter surrounds said outlet, said upper peripheral edge being spaced from said means for attaching.

* * * * *